United States Patent [19]

McAllister

[11] 4,408,761

[45] Oct. 11, 1983

[54] GAME AND GAME DEVICES

[75] Inventor: William McAllister, London, England

[73] Assignee: McAllister (Sports Games) Limited, London, England

[21] Appl. No.: 298,733

[22] Filed: Sep. 2, 1981

[30] Foreign Application Priority Data

Dec. 4, 1980 [GB] United Kingdom ..... 8038885

[51] Int. Cl.[3] ..... A63F 7/06; A63F 7/40

[52] U.S. Cl. ..... 273/85 R; 273/128 R

[58] Field of Search ..... 273/85 R, 128 R, 128 CS, 273/288–291, 293; 16/25, 24; 40/594, 327

[56] References Cited

U.S. PATENT DOCUMENTS

| | | | |
|---|---|---|---|
| 556,329 | 3/1896 | Bowie | 16/24 |
| 797,675 | 8/1905 | Fletcher | 273/128 R |
| 956,969 | 5/1910 | Hussey | 16/24 |
| 1,656,936 | 1/1928 | Beal | 273/128 R |
| 2,494,929 | 1/1950 | Colaluca | 273/128 R |
| 3,310,307 | 3/1967 | Brown | 273/128 R X |
| 3,456,281 | 7/1969 | Lowry | 16/25 |
| 3,784,204 | 1/1974 | Felber | 273/128 R |
| 3,954,267 | 5/1976 | Freeman et al. | 273/128 R X |
| 4,000,900 | 1/1977 | Lehmann | 273/128 R X |

FOREIGN PATENT DOCUMENTS

| | | | |
|---|---|---|---|
| 446956 | 3/1948 | Canada | 273/128 R |
| 27284 | of 1908 | United Kingdom | 273/85 R |
| 176164 | 3/1922 | United Kingdom | 273/128 R |
| 277470 | 9/1927 | United Kingdom | 273/85 R |
| 341651 | 1/1931 | United Kingdom | 273/85 R |
| 427403 | 4/1935 | United Kingdom | 273/85 R |
| 445500 | 4/1936 | United Kingdom | 273/85 R |
| 486047 | 5/1938 | United Kingdom | 273/85 R |
| 638476 | 6/1950 | United Kingdom | 273/85 R |

*Primary Examiner*—Paul E. Shapiro

*Attorney, Agent, or Firm*—Murray & Whisenhunt

[57] ABSTRACT

The invention provides a table game resembling football played with cues, players and a ball, the players being mounted on a housing supported on a rotary ball whereby the players can roll along the table to engage the ball.

9 Claims, 6 Drawing Figures

FIG. 1
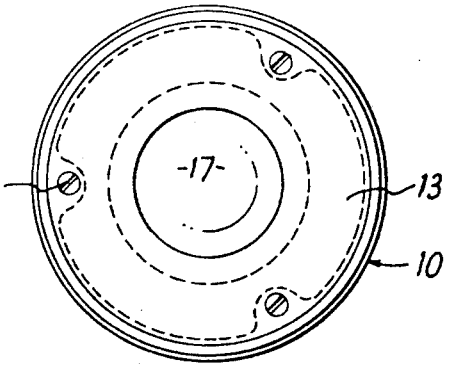
FIG. 2
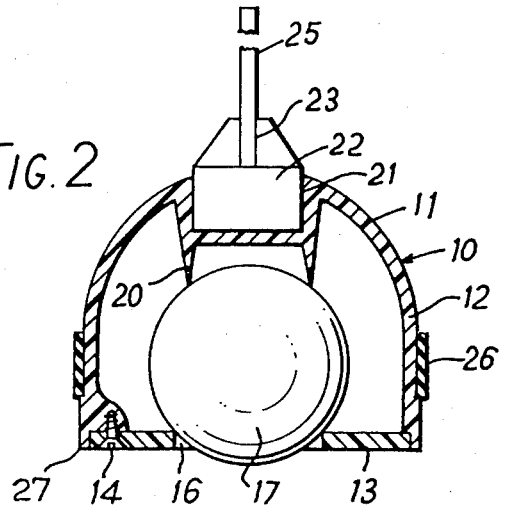
FIG. 3
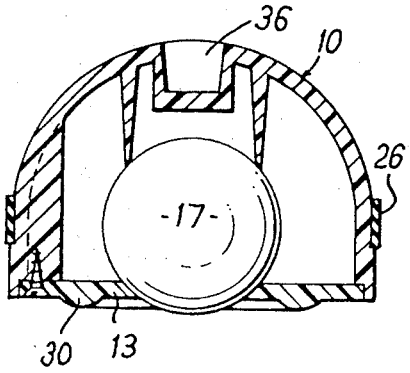
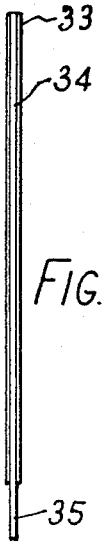
FIG. 4
FIG. 5
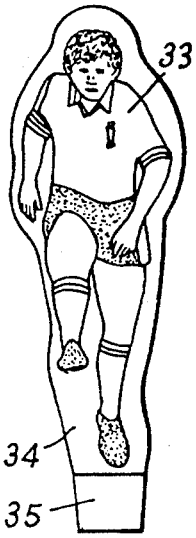

GAME AND GAME DEVICES

BACKGROUND TO THE INVENTION

This invention relates to a device suitable for playing a table game and to a table game resembling a mixture of snooker and football. This games requires a board covered with green baize marked out like a football pitch with a goal at each end, a ball, devices representing players which can slide freely in all directions on the baize, and snooker cues with which the actual players strike the devices causing them to hit the ball.

OBJECT OF THE INVENTION

The object of the invention is to make the player device and game.

SUMMARY OF THE INVENTION

According to the invention the device comprises a hollow housing having a base provided with a central aperture and a ball bearing preferably having a diameter of between 0.75 and 1.25 inch (1.9 to 3.18 cms) housed rotatably in the base and projecting slightly through the aperture.

The ball seats on the baize and when the device is struck with the cue it slides on the baize but can tilt to engage the edge of the base with the baize to act as a brake.

The game may comprise a table having a goal at each end, two cues, ten of said devices (five each side), pieces on said devices representing players and a ball.

BRIEF DESCRIPTION OF DRAWINGS

A constructional form of the invention will now be described by way of example with reference to the accompanying diagrammatic drawings, wherein:

FIG. 1 is an underneath plan view of a player device made in accordance with the invention;

FIG. 2 is a vertical sectional view thereof;

FIG. 3 is a sectional view of a modification;

FIG. 4 is a side view of a player;

FIG. 5 is a front view of the player, and

DESCRIPTION OF PREFERRED EMBODIMENT

Figure 6:
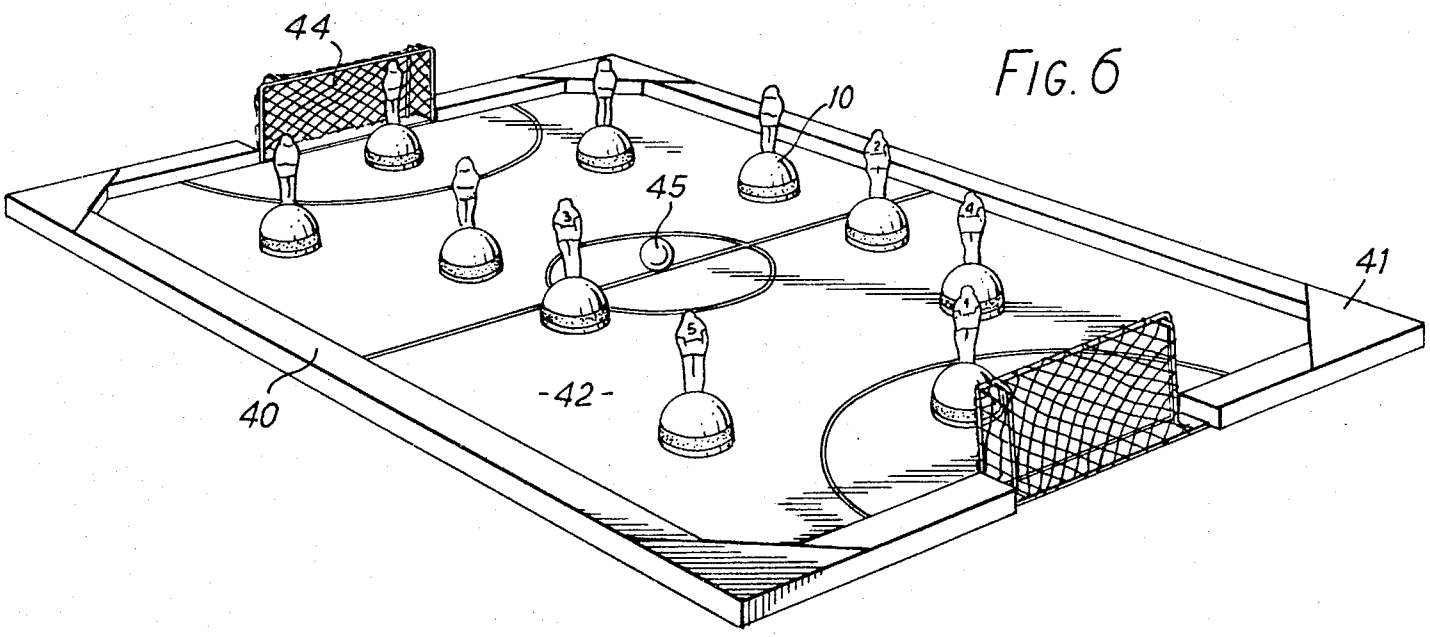
FIG. 6 is a perspective view of the game.

A moulded hollow housing 10 of plastics material has an approximately semi-spherical upper part 11 and a cylindrical lower part 12. The lower end of part 12 is fitted with a circular base 13 attached by screws 14. The base 13 has a central aperture 16 on the edge of which a ball bearing 17 seats. The ball is held lightly on to the seating by inwardly extending projections 20 integral with the housing.

The housing has an exterior recess 21 at its upper part to receive a plug 22 which has a slot 23 to receive a card 25 in the shape of a football player.

A resilient ring 26 is provided around the lower part of the housing against which the cue will be struck.

The ball 17 projects below the bottom face of the base 13 about 1.5 to 3.0 mm, e.g. 2 mm so that when the device skids across the board it can tilt slightly to bring the lower edge 27 of the housing into contact with the board to act as a brake.

FIG. 3 shows a modification in which an annular bead 30 of curved section is provided on the base 13 which projects slightly below the walls of the housing. The ball projects very slightly below the bead. Instead of the recess 21 and plug 22, the housing has a narrow slot 36 to receive and support a tab 35 of a player 33.

FIGS. 4 and 5 show a player. For a complete game there may be supplied a table having a goal at each end, two cues, and ten of the described devices (five each side) to carry players which are provided as stiff paper sheets each having a peel-off adhesive sheet attached thereto which is printed in the form of players 33 and cut around each so that the players can be peeled off, and ten plastics pieces 34 in the form of players approximately the same size as the peel-off players. The plastics pieces 34 have tabs 35 to insert in slots in the tops of the devices. The purchaser of the games peels off the players and sticks them on to each side of the plastics pieces and mounts them on said devices.

One form of the game is shown in FIG. 6. A table comprises a rectangular frame 40 having corner pieces 41 which limit the playing area at the corners and a horizontal board 42 covered with baize. The board is held in rebates in the frame. The board has a goal 44 at each end which may be about nine inches (22.86 cms) long for a ball 45 of one and a quarter inches (3.18 cms) diameter. The ball 45 is hard but resilient rubber or polymer plastics. The board is marked with suitable lines to represent a football pitch.

The game may be played according to the following rules:

Two or four players may take part and may only strike the "player devices" with a cue to cause the devices to strike the ball. A player strikes a goalkeeper of a team with his cue and the goalkeeper is caused to strike the ball. If the ball comes to rest close to a player device this is considered to be a "tackle" and the other player has the play.

Possession

When a goalkeeper has passed the ball to another player device, the same player may play the ball twice and must pass the ball to another player device on the first or second strike or attempt to score or may pass back to his goalkeeper with the first or second strike.

Tackle

This occurs when the ball is played by a player and fails to reach one of his own players and finishes closer to an opponent's player device.

Scoring

With the exception of the goalkeeper, any other player can score. When you think you are in a position to score a goal, you must inform your opponent that you intend to "Shoot". Your opponent must have the opportunity to position his goalkeeper before you take the shot with any of your four out-field players. A goal can be scored direct or by the ball hitting any other player and going in-off into the goal. The ball may also be doubled across the table into the goal. Once having said you are going to "shoot" you are committed to doing so. Whether a goal is scored or not, after your attempt at scoring your opponent takes possession. He re-starts the game with his goalkeeper.

Fouls

A foul is awarded when a player device hits an opponents player device before hitting the ball first. When taking the free kick your opponents devices must be approximately 10 inches away from where the kick is to be taken.

Throw-in

Should the ball leave the table, it should be replaced at the nearest player device to where the ball went out of play. The team awarded the free kick may place the ball in front of, or behind the player device as they wish.

Goal Area

Only the goalkeeper is allowed in the goal area. Should he cross the line of the area, a free kick is awarded against him. The kick to be taken from the point where he crossed the line. When an out-field player device crosses the line, a free kick is awarded against him from where he crossed the line. When this happens, the ball should be cut back to the goalkeeper to avoid the player device crossing the line into the area.

The device may be adapted also for other games or merely for bowling.

I claim:

1. A playing device for playing a table game on a table having a playing surface, said device comprising a housing means, including:

a semi-spherical shaped hollow member providing a domed upper outer surface;

a base plate mounted on an underside of said hollow member;

means defining a central aperture in said base plate, said central aperture having a ball means supporting edge;

said hollow member including a plurality of inwardly extending projections each having a free end and each extending inwardly within said hollow member;

ball means rotatably mounted in said base plate and projecting slightly through said central aperture, each of said free ends of said inwardly extending projections contacting said ball means to hold said ball means in contact with said internal edge of said central aperture and to keep said ball means projecting slightly through said central aperture, while enabling said ball means to rotate easily;

said housing means having external side and bottom surfaces forming a sharp lower braking edge on said housing means, said lower edge achieving a braking effect when said housing means tilts to engage said lower edge with said playing surface.

2. A device according to claim 1, wherein a resilient ring extends around a lower part of said housing means.

3. A device according to claim 1 or 2, further comprising means in said upper outer surface of said hollow member for supporting a player-simulating element.

4. A device according to claim 1, wherein the ball means has a diameter from 1.9 to 3.18 cms, and projects below said housing means by a distance of 1.5 to 3.0 mm.

5. A device according to claim 1, wherein an annular bead of curved section is provided on the bottom surface of the housing means.

6. A table game, comprising:

a table having a playing surface and a goal at each end;

a plurality of playing devices, each device comprising a housing means, including:

a semi-spherical shaped hollow member providing a domed upper outer surface;

a base plate mounted on an underside of said hollow member;

means defining a central aperture in said base plate, said central aperture having a ball means supporting edge;

said hollow member including a plurality of inwardly extending projections each having a free end and each extending inwardly within said hollow member;

ball means rotatably mounted in said base plate and projecting slightly through said central aperture, each of said free ends of said inwardly extending projections contacting said ball means to hold said ball means in contact with said internal edge of said central aperture and to keep said ball means projecting slightly through said central aperture, while enabling said ball means to rotate easily;

said housing means having external side and bottom surfaces forming a sharp lower braking edge on said housing means, said lower edge achieving a braking effect when said housing means tilts to engage said lower edge with said playing surface;

cues for striking said playing devices; and a ball.

7. A table game according to claim 6, wherein said table is a rectangular frame having a board defining a playing area, said frame having corner pieces at corners of the frame limiting said playing area at said corners.

8. A table game according to claim 6, including a peel-off adhesive sheet printed to represent players and cut around each player, and pieces mountable on said devices to which peel-off adhesive sheets can be stuck.

9. A table game according to claim 6, wherein there are two cues, ten of said playing devices (5 each side) and pieces on said playing devices representing players.

* * * * *